United States Patent [19]

Claxton

[11] 3,967,807

[45] July 6, 1976

[54] SELF-CLOSING BOOK HOLDER AND SUPPORT

[75] Inventor: H. Hugh Claxton, Lachine, Canada

[73] Assignee: Northern Electric Company Limited, Montreal, Canada

[22] Filed: Sept. 8, 1975

[21] Appl. No.: 611,070

[52] U.S. Cl. ..... 248/447
[51] Int. Cl.[2] ..... A47B 97/04
[58] Field of Search ..... 248/447; 312/233

[56] References Cited

UNITED STATES PATENTS

| | | | |
|---|---|---|---|
| 1,238,899 | 9/1917 | Enell | 248/447 |
| 1,923,096 | 8/1933 | Keely et al. | 312/233 |
| 2,239,322 | 4/1941 | Heymans | 312/233 |
| 3,791,677 | 2/1974 | Nawman | 248/447 X |

*Primary Examiner*—Lawrence J. Staab
*Attorney, Agent, or Firm*—Sidney T. Jelly

[57] ABSTRACT

A self-closing book holder and support has a back portion, for attachment to a support structure, and two spaced apart forwardly extending wings. Each wing has a forwardly and downwardly inclined top surface, an inner surface and a curved portion blending the top surface and inner surface. A book is normally supported from its top rear edge and hangs down between the wings, the top surfaces of the wings providing support surfaces for the book when held by a user in an open position. On release of the book, the inclination of the top surfaces of the wings and the curved portions, cause the book to close and pivot down between the wings. An enclosure can be provided which encloses the book when in a closed condition.

2 Claims, 9 Drawing Figures

SELF-CLOSING BOOK HOLDER AND SUPPORT

This invention relates to self-closing book holders, and in particular though not exclusively, to holders for telephone directories and other books provided in public access positions. A feature of the invention is the provision of an enclosure which is caused to close about the book as the book itself closes.

The provision of books, such as telephone directories, in public access positions, for example telephone booths, subjects such books to considerable wear and tear. Thus, for example, in modern outdoor telephone booths it is possible for rain to damage a directory when left in an open position. It is necessary to provide some form of support for a user to rest the directory on while looking for a telephone number, and while dialling the number, but often, even though provision is made for the directory to be stored in an enclosed position, it is left out on the support, either in an open or closed position.

Similar difficulties and disadvantages occur for other uses, for example dressmaking pattern books, and similar books which if left out on display can be damaged by users of other books or by persons placing parcels on unused books.

The present invention provides a support platform which will support a book in an open condition while held by the user, but which causes the book to close and pivot downwards by the top back edge on release of the book.

It is also a factor that even when a book is stored in a closed condition the weather can still affect it. This is particularly so with the modern acoustic telephone booths which are open on one side. It is a feature of the invention that a weather proof enclosure for the book can be provided, the book mounted in the enclosure and the enclosure pivotaly attached at its top rear edge to the support. On lifting and opening, the enclosure permits access to the book, but on release of the book, or enclosure, the whole closes and pivots downwardly, opposed parts of the enclosure overlapping to enclose the book and prevent, or at least substantially reduce, ingress of dirt and moisture.

This invention will be readily understood by the following description of two embodiments, by way of example, in conjunction with the accompanying drawings in which.

The book support and holder, as illustrated in FIGS. 1 to 4 is composed essentially of a back portion 10 and two forwardly projecting wings 11 and 12, one on each side of the back portion.

Figure 8:
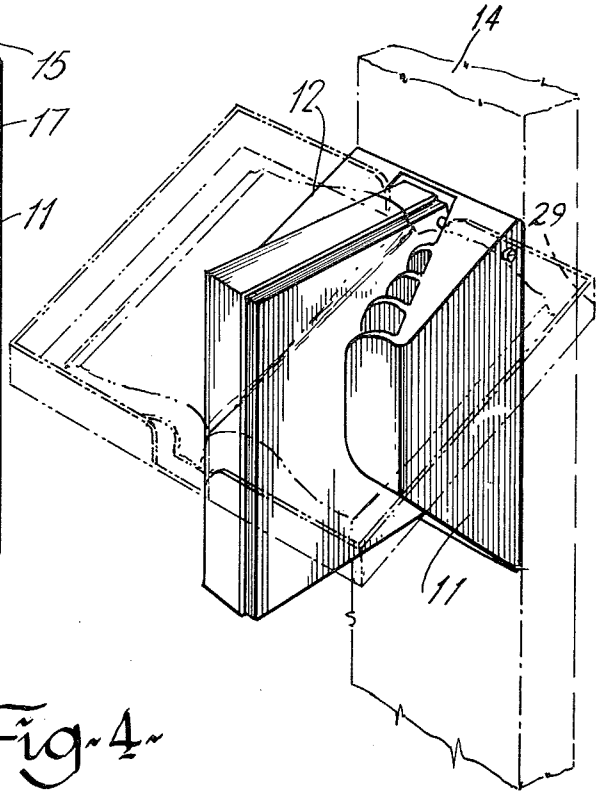
FIG. 8 is a perspective of the book enclosure of FIGS. 5, 6 and 7, in a support and holder as in FIGS. 1 to 4.
Figure 9:
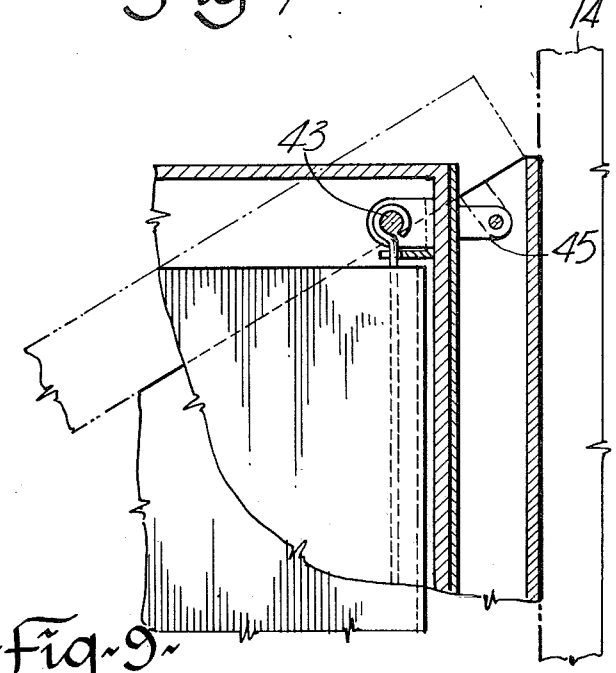
FIG. 9 is a cross-section on the line IX—IX of FIG. 7, to a larger scale, illustrating the attachment of book and enclosure to the support.

The back portion 10 has a rear surface 13 which is positioned against a support structure, indicated generally at 14 in chain dotted outline, in FIGS. 8 and 9 to which it can be fastened by screws or nuts and bolts for example. Various forms of support structure 14 can be provided.

Back portion 10 has a narrow top surface 15 and side surfaces 16. The wings 11 and 12 extend forwardly from the back portion, and each wing also has a top surface 17 which extends forwardly from the forward edge of top surface 15 in a downward inclination.

Extending from the side surfaces 16, inwardly, are a series of parallel webs 18. At their top ends, the webs blend into the top surfaces 17 by radii 19. The inner edges 20 of the webs 18 are spaced apart a distance to readily accept the book to be held by the support and holder. Each wing has a lower surface 21 which is inclined downwardly and rearwardly.

Figure 3:
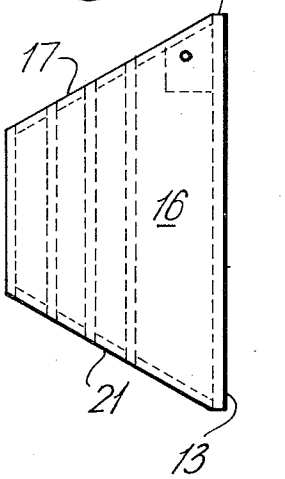
FIG. 3 is a side view of the support and holder of FIG. 1.
Figure 2:
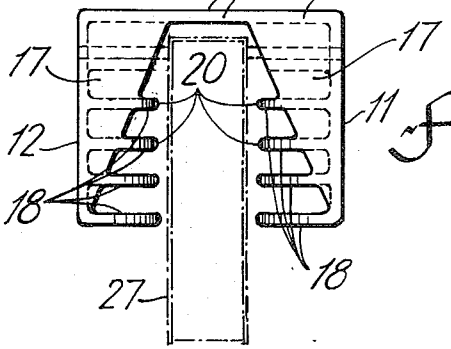
FIG. 2 is a top view of the support and holder of FIG. 1.
Figure 1:
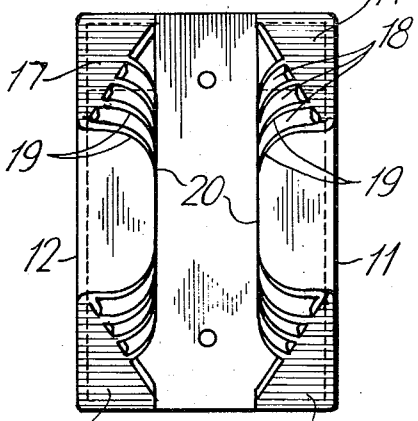
FIG. 1 is a front view of a book support and holder.

Side view FIG. 3 particularly illustrates the downward inclination of the top surfaces 17 and the inclination of the lower surfaces 21. FIG. 1 particularly illustrates the blending of the webs 18 with the top surfaces 17 by radii 19. The inner edges 20 hold a book in a closed position, a book 26 being indicated in dotted outline at 27 in FIG. 2, and in full outline in FIG. 4.

Normally the book 26 hangs down between the wings 10 and 11 attached at the top rear edge to the support and holder by a hinge 28, formed by a rod passing through wings 11 and 12. To use the book it is lifted up and opened, resting across the inclined top surfaces 17 of the wings 11 and 12. As long as the book is held by the user it will stay resting on the wings, with the back of the book between the wings. However, as soon as the user lets go of the book, the downward inclination of the top surfaces 17 and the radii 19 cause the book to close and hinge downwardly to come to rest between the wings.

Figure 4:
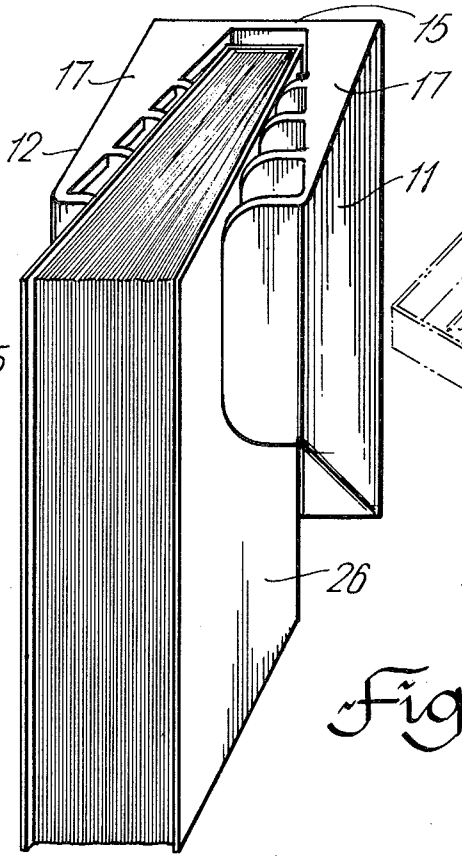
FIG. 4 is a perspective view of the support and holder of FIGS. 1, 2 and 3, showing a book in the closed position.

Thus the book at all times is held between the wings 11 and 12, in a closed condition, except when held up in an open position by the user, as indicated in FIG. 4 where the book is indicated in open condition by dotted outline 29. This avoids the book being left open with possible damage to the pages.

As an additive feature, particularly useful for telephone directories provided in outdoor telephone booths, and especially in the semi-open booths composed of a curved sheet of plastic glass material with one side permanently open, a book enclosure can be provided, which completely encloses the book in the closed position.

Figure 7:
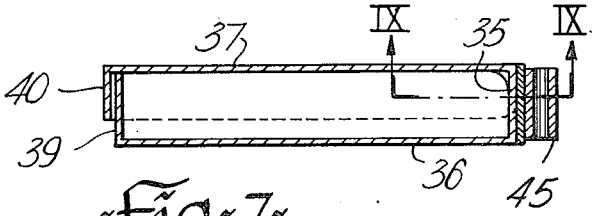
FIG. 7 is a cross-section through the enclosure of FIGS. 5 and 6, in a closed condition.
Figure 5:
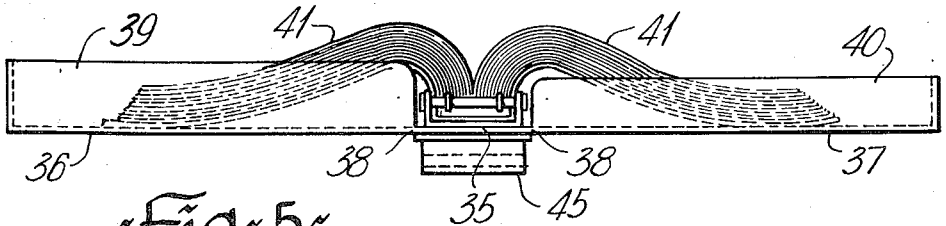
FIG. 5 is an end view of a book enclosure, in the open position, for use with the support and holder of FIGS. 1 to 4.
Figure 6:
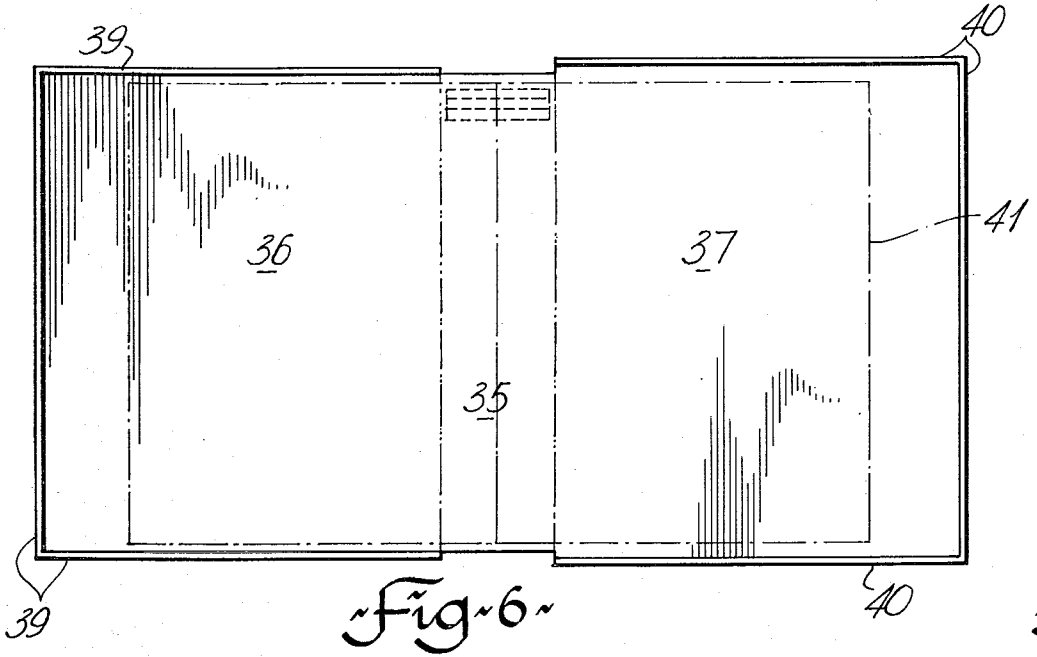
FIG. 6 is a plan view of the enclosure of FIG. 5.

FIGS. 5, 6 and 7 illustrate on form of enclosure, comprising a back portion 35 and two side members 36 and 37. The side portions are hinged at 38 and can fold up to form an enclosure. Side member 36 has an upward extending rim 39 formed adjacent the top, bottom and side edges of the member 36 and side member 37 has an upward extending rim 40 formed at its top, bottom and side edges. In the particular example illustrated rim 40 can fit over the rim 39 when the enclosure is closed, as illustrated in FIG. 7.

A book, for example a telephone directory, is attached by a back plate, not shown, to the back portion 35 of the enclosure, by hinge 43 for example, and book and enclosure are attached to the support and holder by a rod 44 and bracket 45. A book is indicated in dotted outline at 41 in FIG. 6, and in full outline in FIG. 5. In an alternative arrangement, not shown, the back plate to which the book is attached may also form the back portion 35 of the enclosure.

In use the action is similar to that previously described. Normally the enclosed book hangs down between the wings 11 and 12, with the enclosure closed and completely encasing the book. A user lifts up the enclosure and opens it, the enclosure resting on the inclined surfaces 17 of the wings. The book 41 is opened and used as necessary by the user. As long as the enclosure is held in position it stays open, as does also the book. However, as soon as the enclosure is released, it pivots downward at the top edge of the back portion 35 both closing the back and closing the enclosing around the book. The book is thus protected against environmental damage, and misuse.

The form of the enclosure can be varied. It may not be considered necessary to have overlapping rim portions. A rim can be provided on only one side member. The rim may only extend for two sides of a side member, for example the top and front, leaving the bottom open.

What is claimed is:

1. A self-closing book holder and support comprising:

a back portion including a rear surface for positioning against and attachment to a support structure;

two spaced apart wings extending forwardly from each side of said back portion; and hinge means at a top part of said back portion between said wings for hinged attachment of a book at its top back edge to said back portion;

each wing including a side surface and a top surface, said top surface extending laterally inward from said side surface and also extending forward and downward from said back portion, and a plurality of vertical webs extending inwardly from said side surface and having inner edges, said inner edges at a top end of each web extending in an arcuate form upward and outward to an inner edge of said top surface;

said webs of one wing extending towards and in opposition to said webs of the other wing, and said inner ends of said webs defining a space for acceptance of said book therebetween;

the arrangement such that said book can be pivotted forward and upwardly on said hinge means and opened to rest on said top surface while held, release of said book causing the book to pivot and slide down over said arcuate forms at the top ends of said webs, to a closed condition.

2. A book holder and support as claimed in claim 1, including an enclosure for said book, said enclosure including a back portion and two side members, and integral hinge portions hingedly connecting said side members to said back portion of said enclosure;

a rim extending at least along a top edge and a front edge of at least one of said side members, said side members and said rim cooperating in a closed condition to form an enclosure for said book;

means at a top part of said back portion of said enclosure and external of said enclosure for engagement with said hinge means on said back portion of said holder and support, for hinged attachment of said enclosure to said holder and support between said wings;

hinge means at said top part of said back portion of said enclosure inside said enclosure for hinged attachment of said book.

* * * * *